US007587229B2

(12) United States Patent
Ishii et al.

(10) Patent No.: US 7,587,229 B2
(45) Date of Patent: Sep. 8, 2009

(54) SUPERCONDUCTING TUNABLE FILTER HAVING A PATCH RESONATOR PATTERN TUNED BY A VARIABLE DIELECTRIC CONSTANT TOP PLATE

(75) Inventors: Masatoshi Ishii, Kawasaki (JP); Kazunori Yamanaka, Kawasaki (JP); Akihiko Akasegawa, Kawasaki (JP); John David Baniecki, Kawasaki (JP); Kazuaki Kurihara, Kawasaki (JP); Teru Nakanishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 33 days.

(21) Appl. No.: 11/727,660

(22) Filed: Mar. 27, 2007

(65) Prior Publication Data

US 2007/0232499 A1 Oct. 4, 2007

(30) Foreign Application Priority Data

Mar. 30, 2006 (JP) ..... 2006-095250
Dec. 22, 2006 (JP) ..... 2006-346212

(51) Int. Cl.
*H01P 1/203* (2006.01)
*H01B 12/02* (2006.01)

(52) U.S. Cl. ..... 505/210; 333/99 S; 333/205

(58) Field of Classification Search ..... 333/99 S, 333/205, 235; 505/210
See application file for complete search history.

(56) References Cited

U.S. PATENT DOCUMENTS 5,136,268 A * 8/1992 Fiedziuszko et al. ..... 333/204
5,965,494 A * 10/1999 Terashima et al. ..... 505/210
6,029,075 A * 2/2000 Das ..... 505/210
7,148,770 B2 * 12/2006 Toncich ..... 333/205

FOREIGN PATENT DOCUMENTS

JP 9-307307 11/1997
WO WO 97/23012 A1 6/1997
WO WO 01/41251 A1 6/2001

* cited by examiner

*Primary Examiner*—Benny T. Lee
(74) *Attorney, Agent, or Firm*—Fujitsu Patent Center

(57) ABSTRACT

A superconducting tunable filter comprises a dielectric base plate; a patch-shaped resonator pattern formed of a superconducting material on the dielectric base plate; a top dielectric locally placed on the superconducting resonator pattern at a prescribed position and made of a material with an electric-field dependent permittivity; a conducting pattern formed on a top face of the top dielectric; and a bias voltage supply configured to apply a bias voltage between the conducting pattern and the superconducting resonator pattern.

16 Claims, 12 Drawing Sheets

SUPERCONDUCTING TUNABLE FILTER HAVING A PATCH RESONATOR PATTERN TUNED BY A VARIABLE DIELECTRIC CONSTANT TOP PLATE

BACKGROUND OF THE INVENTION

1. Field of the Invention

The present invention relates in general to a superconducting microwave device, and more particularly, to a superconducting tunable filter applied to an ultralow temperature RF front-end of a transmitter of a base station in mobile communications systems.

2. Description of the Related Art

Along with rapid development and spread of mobile phones in recent years, high-speed and high-volume data transmission technologies have becomes indispensable. Because of extremely small surface resistances, as compared with typical good conductors, superconductors have great potential for application to RF filters used in base stations of mobile communications systems, and application to low-loss and high-Q resonators are especially expected.

As illustrated in FIG. 1, an RF signal received at an antenna (ANT) 151 is processed through a bandpass filter (BPF) 152R, a low-noise amplifier (LNA) 153, down converter (D/C) 154, and a demodulator (DEMOD) 155, which components constitute a receiver RF front-end, and then processed at a baseband processing unit 156.

At the transmitter RF front-end, a baseband-processed transmission signal is subjected to processes successively through a modulator (MOD) 157, an up converter (U/C) 158, a high power amplifier (HPA) 159, and a band-pass filter (BPF) 152T, and then transmitted as an RF signal from the antenna 151.

When a superconducting filter is applied to the receiving-end bandpass filter 152R, transmission loss is small and a steep frequency cut-off characteristic can be expected. When it is applied to the transmission-end bandpass filter 152T, an effect of removing distortion generated due to the high power amplifier 159 can be expected. However, the transmitter RF front-end needs a high power system to transmit radio frequency signals, and therefore, today's issue is balancing the compact structure and satisfactory power quality.

In application to the mobile communications field, frequency tunability is in strong demand. In order to achieve a tunable superconducting filter, it is proposed to arrange a plate having a surface covered with a conductive film above a pattern of a superconducting resonator such that the conducting surface faces the superconducting resonator. A piezoelectric device is inserted between the superconducting resonator and the conducting face of the plate to adjust the distance between the two to vary the resonant frequency. See, for example, WO 01/041251.

Because this method uses a mechanical mechanism of an actuator, there are problems of high susceptibility to shaking or vibration and slow response speed.

Another known technique for achieving frequency tunability is to make use of a dielectric having a highly bias-dependent permittivity. It is proposed to form a dielectric film with a bias-dependent permittivity over the pattern of a resonator filter, and to apply an electric voltage to the dielectric film to vary the dielectric constant. See, for example, JP 9-307307A. In this method, an electric voltage is applied in the lateral direction, and the rate of change is small. In addition, since the power durability of this filter device is insufficient, it is only applicable to the receiving front-end.

Still another known method is to place a superconducting dielectric resonator of a parallel plate type on a microstrip line and tune the frequency characteristic of the resonator by making use of the bias-voltage dependency of the permittivity of the dielectric plate. See, for example, WO 97/23012.

FIG. 2A and FIG. 2B illustrate the structure of a tunable superconducting filter disclosed in WO 97/23012. In FIG. 2A, the resonator 111 has a dielectric plate 112 with a nonlinear permittivity, and high temperature superconductor (HTS) plates 113*a* and 113*b* are arranged on both sides of the dielectric plate 112. The HTS plates 113*a* and 113*b* are covered with conducting films 114. FIG. 2B depicts the resonator 111 (FIG. 2A disposed on a microstrip line 115. One of the superconducting plates (113*b* in this example) is electrically connected to the center strip 118 of the microstrip line 115 via the conducting film 114, as illustrated in FIG. 2B. A signal propagates through the resonator 111 from a particular side (designated as INPUT) to the side (designated as OUTPUT) opposing to the particular side. A DC bias voltage is applied between the upper superconducting plate 113*a* of the resonator 111 and the microstrip line 115 using a voltage supply 119. By changing the DC bias voltage, the dielectric constant of the nonlinear dielectric plate 112 is changed to vary the resonant frequency of the resonator 111.

This structure, however, is inferior in power durability, and therefore, it is applicable only to a filter of a receiving-end. Poor power durability in the conventional superconducting filter is attributed to concentration of electric current at the corners or edges of the superconducting resonator patterns.

It may be effective to form a resonator in a patch pattern or a plane FIGURE pattern, including a disk pattern, an oval pattern, an elliptic pattern, and a polygonal pattern, with less sharp corners or edges. Such shapes are effective in reducing local concentration of electric current on the superconducting resonator, and a large power response required for a transmission filter can be achieved. Such a patch shaped (plane FIGURE shaped) superconducting filter may be further developed by arranging a conductive pattern with a certain shape above the superconducting resonator via a dielectric between them to cause coupling corresponding to a desired bandwidth. By generating two orthogonal resonating modes (dual mode) in a round or polygonal resonator, the power characteristic and the frequency characteristic can be improved through reduction of concentration of electric current, and the device can be made compact because of the dual-mode structure.

However, the above-described dual-mode resonator does not have frequency tunability, and it cannot deal with correction of deviation in characteristic features due to variation in manufacturing nor with positive adjustment of characteristic features.

SUMMARY OF THE INVENTION

The present invention was conceived in view of the above-described problems, and the embodiments provide a simple and novel structure of a transmission filter, in which the center carrier frequency and the bandwidth of a superconducting resonator can be adjusted simultaneously or independently of each other, while maintaining satisfactory power characteristics.

To realize such a filter, a dielectric with an electric-field dependent permittivity is provided over a superconducting resonator pattern of a superconducting filter. The resonator pattern is shaped in a patch pattern, including a disk pattern, an elliptic pattern, and a polygonal pattern. A conducting pattern is formed on the overlaid dielectric to produce dual-mode resonance. A bias voltage is applied between the superconducting resonator pattern and the conducting pattern to vary the permittivity or the dielectric constant of the overlaid dielectric so as to tune the filter characteristics.

To be more precise, in one aspect of the invention, a superconducting filter comprises:

(a) a dielectric base plate;

(b) a patch-shaped resonator pattern formed of a superconducting material on the dielectric base plate;

(c) a top dielectric provided over the resonator pattern and having a non-linear electric-field dependency of permittivity;

(d) a conducting pattern formed on the top dielectric to produce coupling corresponding to a prescribed bandwidth; and (e) a bias voltage supply configured to apply a bias voltage to the top dielectric.

With this structure, the dielectric constant of a dual-mode filter can be controlled by applying a bias voltage to the top dielectric, and consequently, the center carrier frequency and/or the bandwidth of the filter can be tuned.

In a preferred example, the bias voltage supply includes bias application wiring connected to the conducting pattern and the superconducting resonator pattern, and the bias application wiring has an inductance component for removing high-frequency components. The bias application wiring is patterned into, for example, a hairpin pattern.

It is preferred that the top dielectric be made of a perovskite oxide or a pyrochlore oxide.

In another aspect of the invention, a superconducting filter comprises:

(a) a dielectric base plate;

(b) a patch-shaped resonator pattern formed of a superconducting material on the dielectric base plate;

(c) a dielectric top plate locally positioned on a part of the superconducting resonator pattern and formed of a material with an electric-field dependent permittivity;

(d) a conducting film formed on a surface of the dielectric top plate; and (e) a bias voltage supply configured to apply a bias voltage between the conducting film and the resonator pattern.

In a preferred example, the superconducting filter further includes an input feeder for supplying a signal to the resonator pattern, and an output feeder for outputting the signal from the resonator. The dielectric top plate is positioned on a line extending so as to be symmetric to the input feeder and the output feeder with respect to the center of the resonator pattern.

In another example, the bias voltage supply includes first bias application wiring formed on the dielectric base plate and electrically connected to the resonator pattern, and second bias application wiring formed on the dielectric base plate and electrically connected to the conducting pattern formed on the dielectric top plate.

In a preferred structure, the first and second bias application wirings include repeat patterns serving as inductance components.

With the above-described structures, the center carrier frequency and the bandwidth can be tuned precisely in a dual-mode superconducting filter.

BRIEF DESCRIPTION OF THE DRAWINGS

Other objects, features, and advantages of the present invention will become more apparent from the following detailed description when read in conjunction with the accompanying drawings, in which.

DETAILED DESCRIPTION OF THE PREFERRED EMBODIMENTS

The preferred embodiments of the invention are now described in conjunction with the attached drawings.

Figure 1:
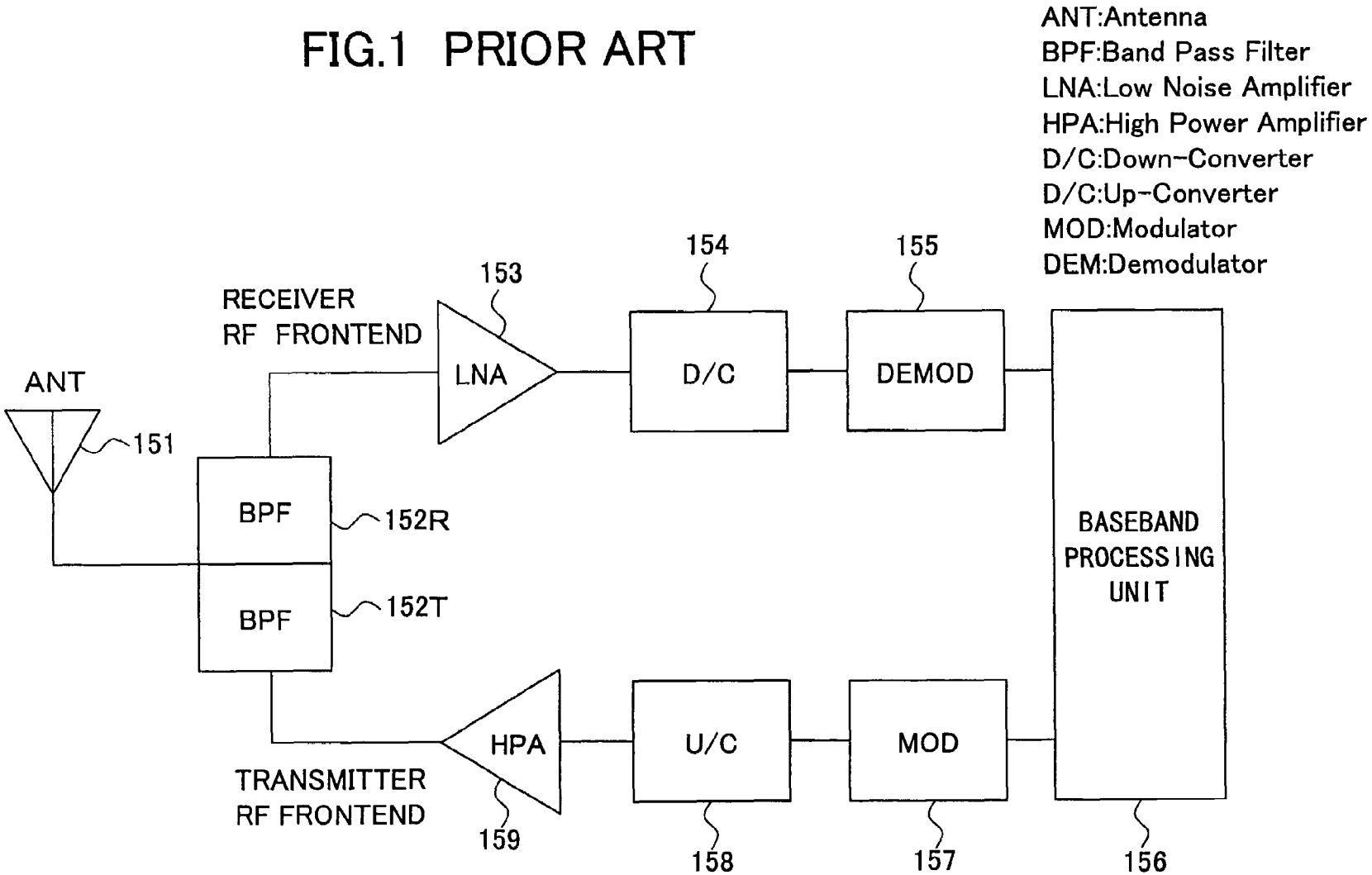
FIG.1 PRIOR ART
FIG. 1 illustrates a general structure of the RF front-end of a conventional mobile communications base station.
Figure 2A:
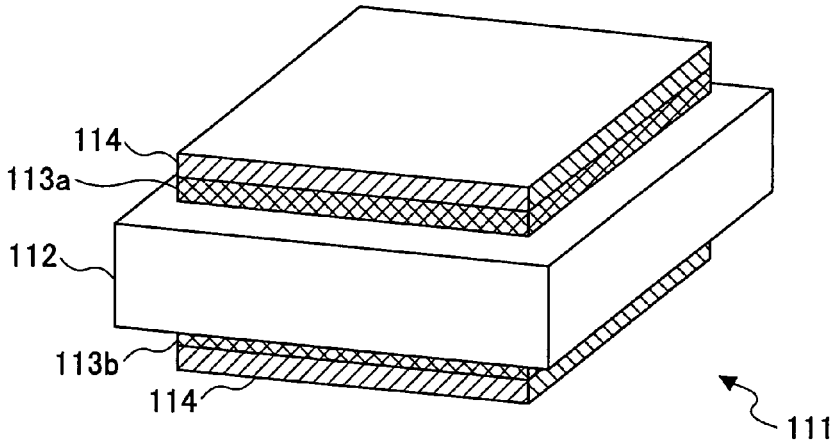
FIG.2A PRIOR ART
FIG. 2A and FIG. 2B are schematic diagram of conventional superconducting tunable filters.
Figure 2B:
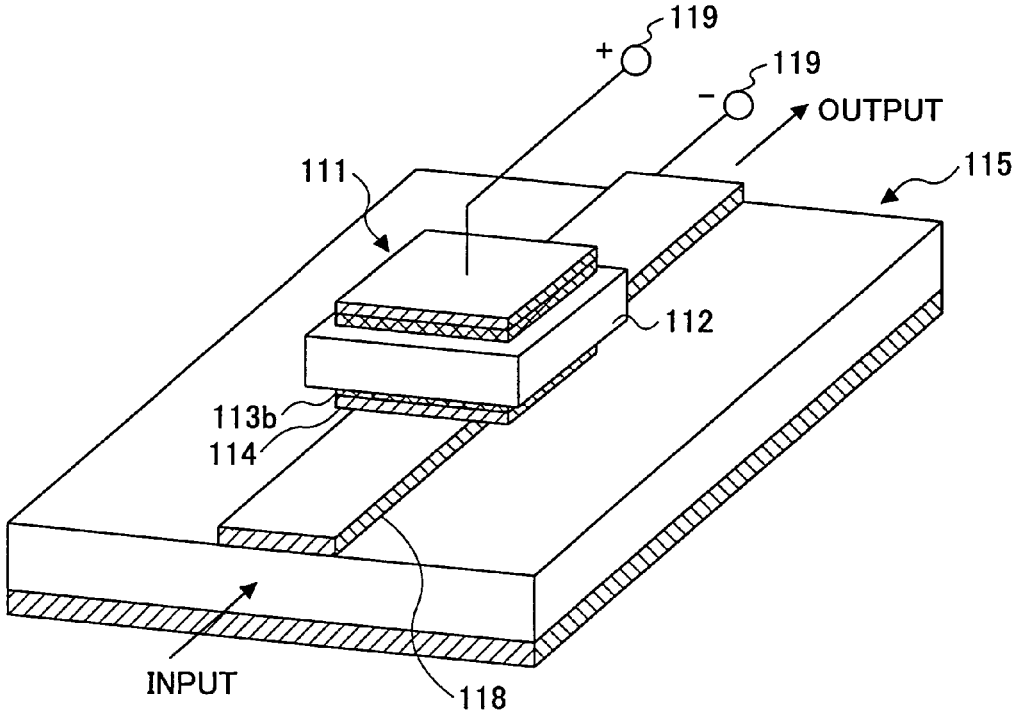
FIG.2B PRIOR ART
Figure 3A:
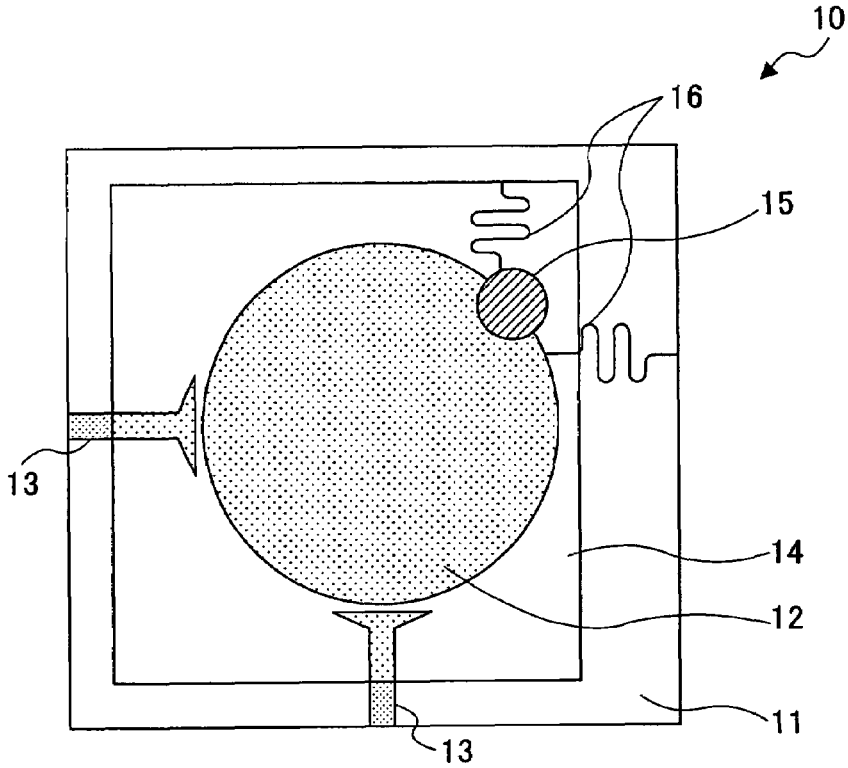
FIG. 3A is a top view of a superconducting filter according to the first embodiment of the invention.
Figure 3B:
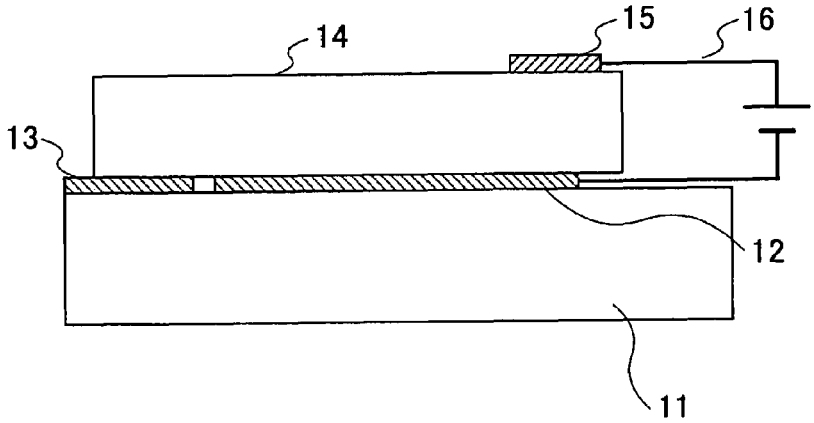
FIG. 3B is a schematic diagram of the cross-sectional view of the superconducting filter.

FIG. 3A and FIG. 3B illustrate a preferred structure of a superconducting filter 10 (FIG. 3A) according to the first embodiment of the invention. FIG. 3A is a top view of the filter, and FIG. 3B schematically illustrates in a cross-sectional view the tunable structure of the superconducting filter 10.

The superconducting filter 10 includes a dielectric base plate 11 made of, for example, MgO single-crystal substrate, a disk-shaped superconducting resonator pattern 12 formed on the top face of the dielectric base plate 11, and signal input/output feeders 13 extending to and from the vicinity of the superconducting resonator pattern 12. The superconducting filter 10 also includes a top dielectric 14 provided over the superconducting resonator pattern 12, a round or elliptic conducting pattern 15 formed on the top face of the top dielectric 14, and wirings 16 for applying a bias voltage to the top dielectric 14. The conducting pattern 15 formed on the top dielectric 14 generates coupling corresponding to a desired bandwidth and allows the superconducting resonator 12 to operate in dual modes.

The dielectric base plate 11 is made of a material showing a low transmission loss at radio frequencies. Examples of such a material include sapphire, LaAlO3 (referred to as "LAO"), and TiO3, in addition to MgO. In general, transmission loss is low in a single-crystal dielectric, as compared with a poly crystalline dielectric, and therefore, a single-crystal dielectric is suitably used for the dielectric base plate 11 of a superconducting filter.

An arbitrary superconductor can be used as the superconducting material of the resonator pattern 12. For example, a metal such as Nb, a nitride such as NbN, or an oxide such as YBCO (Y—Ba—Cu composite oxide), can be suitably used. From the viewpoint of easiness of handling, it is desired to use a high temperature oxide superconductor (such as YBCO) having a high critical temperature. Preferred examples of oxide superconductor include RBCO (R—Ba—Cu—O) in which Nd, Sm, Gd, Dy, or Ho can be used, in place of yttrium (Y), as the element R. Other oxide superconductors, such as BSCCO (Bi—Sr—Ca—Cu—O), PBSCCO (Pb—Bi—Sr—Ca—Cu—O), CBCCO ($Cu—Ba_p—Ca_q—Cu_{r-x}$, $1.5<p<2.5$, $2.5<q<3.5$, $3.5<r<4.5$) can also be applicable to the superconducting resonator.

It is desired to shape the superconducting resonator pattern 12 into a round shape from the viewpoint of reducing concentration of electric current and improving the power durability. Different plane FIGURE patterns, such as ellipses, polygons, and annulii, can also be used because these shapes are advantageous in power durability. The term "patch pattern" or "plane FIGURE pattern" used in the specification and claims represents a two-dimensionally spread pattern including a disk pattern, an oval pattern, an elliptic pattern, a polygonal pattern, and an annular pattern, which is distinguished from a linear pattern (a strip or line pattern).

The top dielectric 14 is made of a material with highly electric-field-dependent permittivity (i.e., with non-linear electric-field dependency of the dielectric constant) and with low transmission loss at radio frequencies. For example, perovskite oxide, such as SrTiO3 or (Ba, Sr)TiO3, and pyrochlore oxide, such as BZN (Bi—Zn—Nb composite oxide), are suitably used. The top dielectric 14 may be a poly-crystalline or single-crystal dielectric plate placed over superconducting resonator pattern 12, or alternatively, it may be a poly-crystalline or single-crystal dielectric layer grown over the superconducting resonator pattern 12.

One of the input/output feeders 13 is used to supply a signal to the superconducting resonator 12, and the other is used to output the signal from the superconducting resonator 12. Although not shown in FIG. 3B, a ground film (i.e., a ground electrode) is formed on the back bottom face of the dielectric base plate 11 using a superconducting material.

In order to supply a bias voltage to the top dielectric 14 with electric-field dependent permittivity, a bias application wiring 16 is connected to each of the dual-mode producing conducting pattern 15 formed on the top dielectric 14 and the superconducting resonator pattern 12. Under the application of a bias voltage, the permittivity or the dielectric constant of the top dielectric 14 is changed to tune the filter characteristics. In this regard, the top dielectric 14 may be called a "permittivity variable dielectric 14".

In the example shown in FIG. 3A, the bias application wiring 16 includes a pattern involving an inductance component so as to block a radio frequency component from entering the DC power source. This arrangement can prevent high frequency loss from occurring in the bias apply wiring 16. The bias application wiring 16 may be patterned into a hairpin pattern with repeated U, or a zigzag pattern with repeated V.

Figure 4:
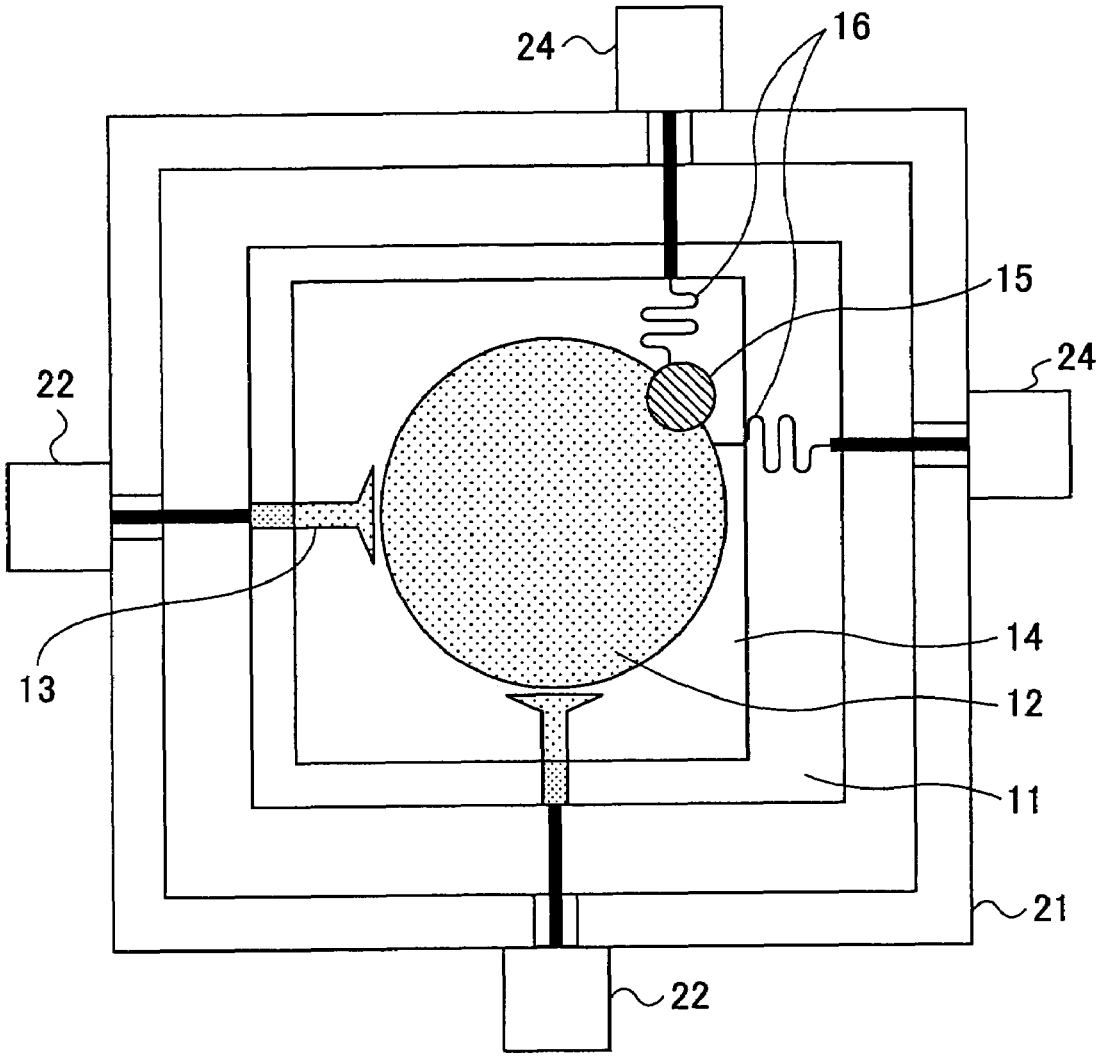
FIG. 4 is a plan view of the superconducting filter of FIG. 3 accommodated in a metal package.
Figure 5:
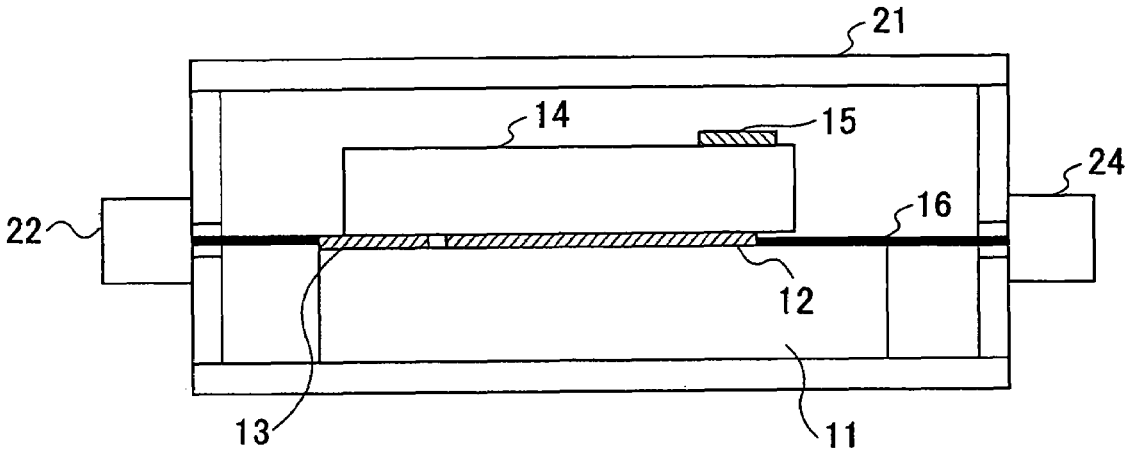
FIG. 5 is a cross-sectional view of the superconducting filter of FIG. 3 accommodated in the metal package.
Figure 6A:
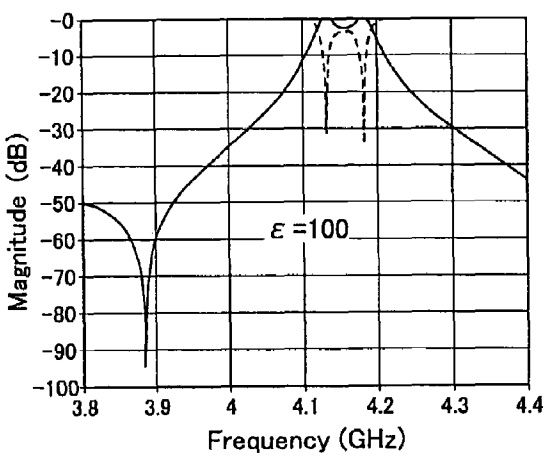
FIG. 6A through FIG. 6F are graphs of filter characteristics under different bias voltages applied between the superconducting resonator pattern and the dual-mode generating conducting pattern.
Figure 6B:
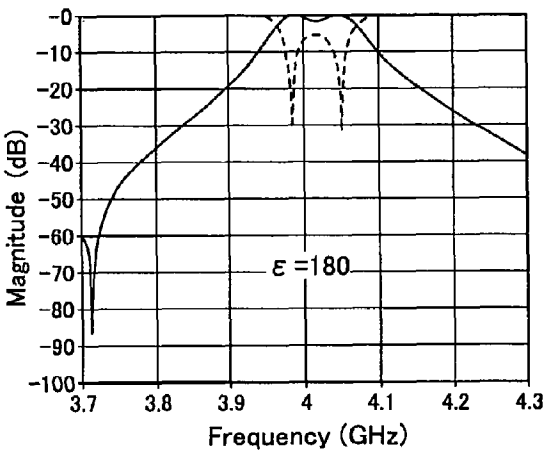
Figure 6C:
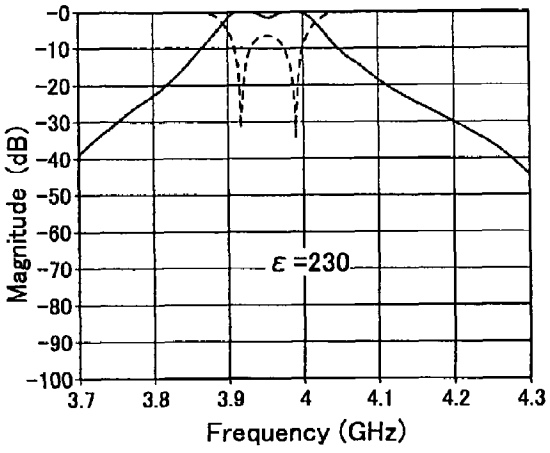
Figure 6D:
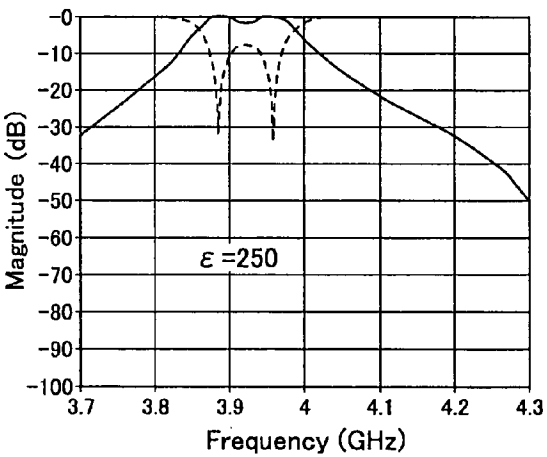
Figure 6E:
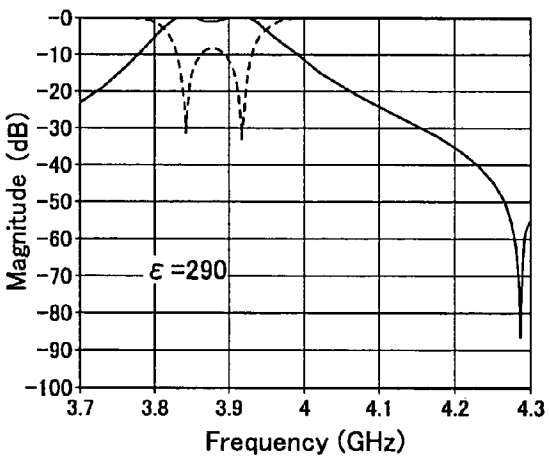
Figure 6F:
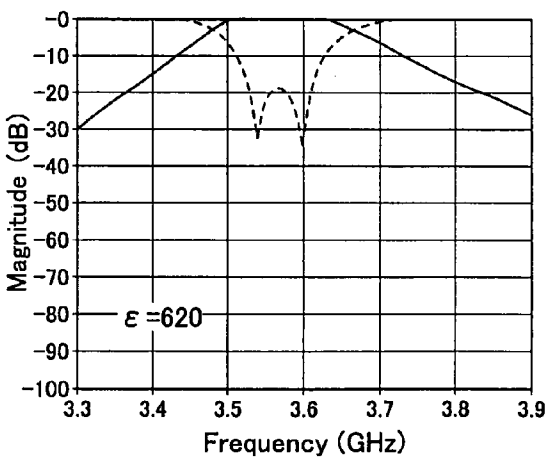

FIG. 4 is a schematic top view of the superconducting filter 10 shown in FIGS. 3A and 3B accommodated in a metal package 21 for application to a transmission filter of a base station of a mobile communications system. FIG. 5 is a cross-sectional view of the packaged filter. In actual use, the superconducting filter 10 packaged in the metal package 21 is placed in a cold chamber furnished with a freezer and a vacuum heat insulator. As shown in FIGS. 4 and 5, the superconducting filter 10 includes the dielectric base plate 11 and the top dielectric 14. The feeders 13 for inputting and outputting signals to and from the superconducting resonator 12 are connected to the input connector and output connectors 22. The bias application wirings 16 are connected to bias application connectors 24 provided on the metal package 21. A bias voltage is applied between the dual-mode producing conducting pattern 15 and the superconducting resonator pattern 12 from the external DC power source via the bias application wirings 16.

FIG. 6A through FIG. 6F are simulation graphs showing the tunability of the superconducting filter of the first embodiment. By applying a bias voltage to the superconducting filter 10 shown in FIGS. 3A and 3B, the dielectric constant $\in$ of the top dielectric 14 is changed as follows: 100 in FIG. 6A, 180 in FIG. 6B, 230 in FIG. 6C. 250 in FIG. 6D, 290 in FIG. 6E and 620 in FIG. 6F. In the graphs, the dashed lines indicate input reflection characteristics (S11), and the solid lines indicate transmission characteristics (S21).

It is understood from the graphs that along with the changes in dielectric constant from $\in=100$, $\in=250$, to $\in=620$, the center carrier frequency changes from 4.16 GHz, 3.92 GHz, to 3.57 GHz, respectively. In addition, along with the change in dielectric constant, bandwidth also changes. The simulation result at $\in=620$ is obtained with no bias voltage application. By increasing the bias voltage form zero level, the dielectric constant decreases.

The rate of change in center carrier frequency and bandwidth differs among dielectric materials.

Figure 7A:
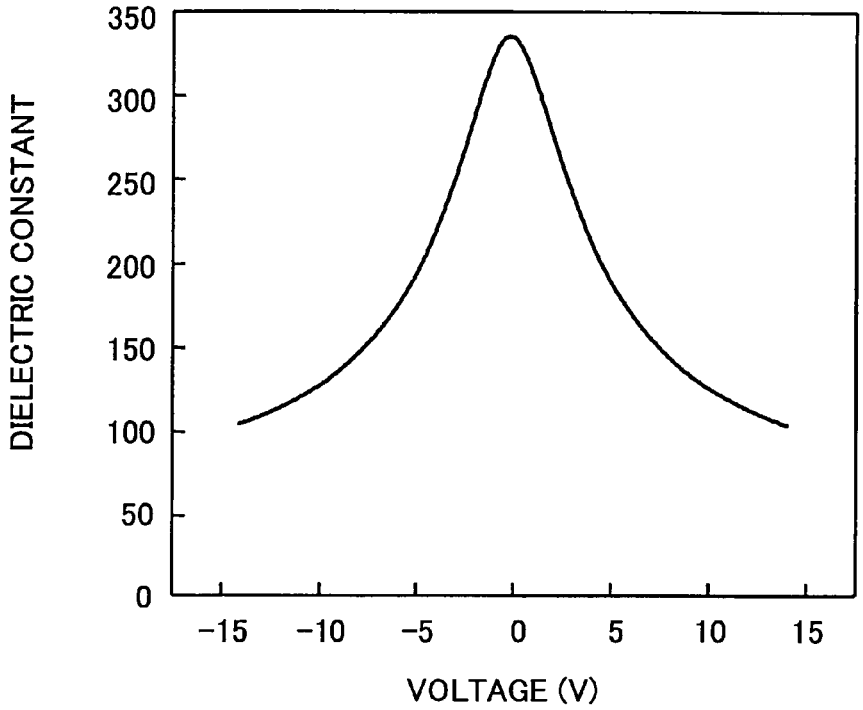
FIG. 7A and FIG. 7B are graphs showing voltage dependency of the dielectric constants of different materials.
Figure 7B:
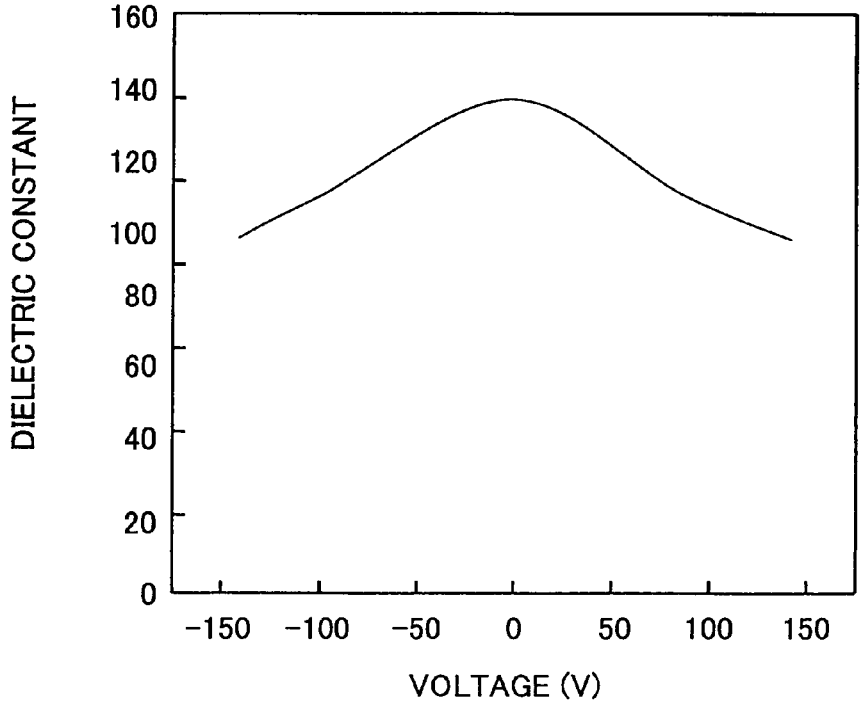

FIG. 7A is a graph of dielectric constant of BST thin film as a function of applied bias voltage, and FIG. 7B is a graph of dielectric constant of BZN plate as a function of applied bias voltage. It is preferred to use a BST thin film as the top dielectric 14 if efficient change in center carrier frequency and bandwidth is required. On the other hand, if the major purpose is to carry out fine tuning of the filter, a BZN plate is suitably used for the top dielectric 14.

In addition, even if a same dielectric material is used, the rate of change of the permittivity under the application of bias voltage varies depending on the fabrication process. For example, the dielectric constant of a BST thin film becomes 600 or higher without application of a bias voltage depending on the film formation process.

Samples (test devices) of superconducting filter 10 were actually fabricated to measure the center carrier frequency under the application of bias voltage to evaluate the bias voltage dependency of the filter characteristics.

EXAMPLE 1

A 20×20×0.5 [mm] MgO single-crystal plate is used as the dielectric base plate 11 of the superconducting filter 10. A disk-shaped superconducting resonator pattern 12, a bias application hairpin wiring 16 extending from the resonator pattern 12, and input/output feeders 13 are formed on the MgO dielectric base plate 11 by epitaxial growth of a YBCO thin film and a patterning process. The diameter and the thickness of the superconducting resonator pattern 12 are 128 mm and 0.5 μm, respectively. A ground electrode (ground film) is also formed on the back face of the MgO dielectric base plate 11 by epitaxial growth of a YBCO thin film.

A BZN plate is used as the top dielectric 14, and is placed on the YBCO patterned face of the MgO dielectric base plate 11. On the top face of the BZN plate are formed in advance a dual-mode producing conducting pattern 15 with a diameter of 38 mm and a bias application hairpin wiring 16.

This superconducting filter 10 has a center carrier frequency at 3.95 GHz without application of a bias voltage. Upon application of 60 V bias, the center carrier frequency shifts to 4.05 GHz. The center carrier frequency changes by 0.1 GHz.

EXAMPLE 2

As in the first example, a disk-shaped superconducting resonator pattern 12, a bias application hairpin wiring 16 extending from the resonator pattern 12, and input/output feeders 13 are formed on a 20×20×0.5 [mm] MgO single-crystal plate 11. The diameter and the thickness of the disk resonator 12 are 128 mm and 0.5 μm, respectively.

A (Ba, Sr)TiO3 thin film is formed by epitaxial growth over the dielectric base plate 11. A YBCO thin film is formed over the (Ba, Sr)TiO3 film by epitaxial growth, and patterned into a dual-mode producing conducting pattern 15 with a diameter of 38 mm and a hairpin wiring 16 for bias application.

This superconducting filter 10 has a center carrier frequency at 3.90 GHz without application of a bias voltage. Upon application of 30 V bias, the center carrier frequency shifts to 4.10 GHz. A 0.2 GHz change is achieved.

In this manner, in the first embodiment, the permittivity of the top dielectric 14 with a dual-mode producing conducting pattern 15 formed on the top face is changed. Consequently, the center carrier frequency and the bandwidth of a dual-mode resonator can be tuned precisely.

Figure 8:
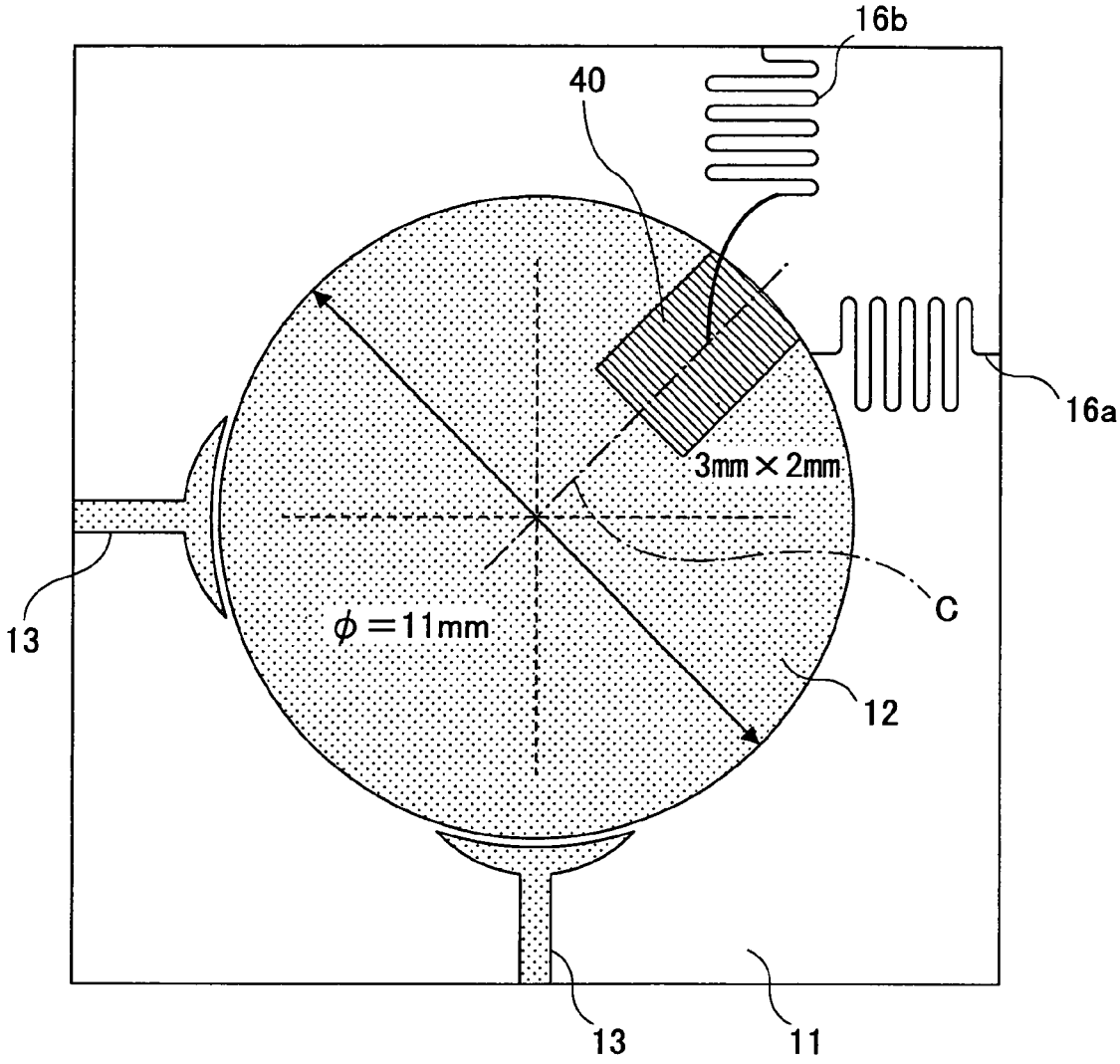
FIG. 8 is a plan view of a superconducting filter according to the second embodiment of the invention.
Figure 9A:
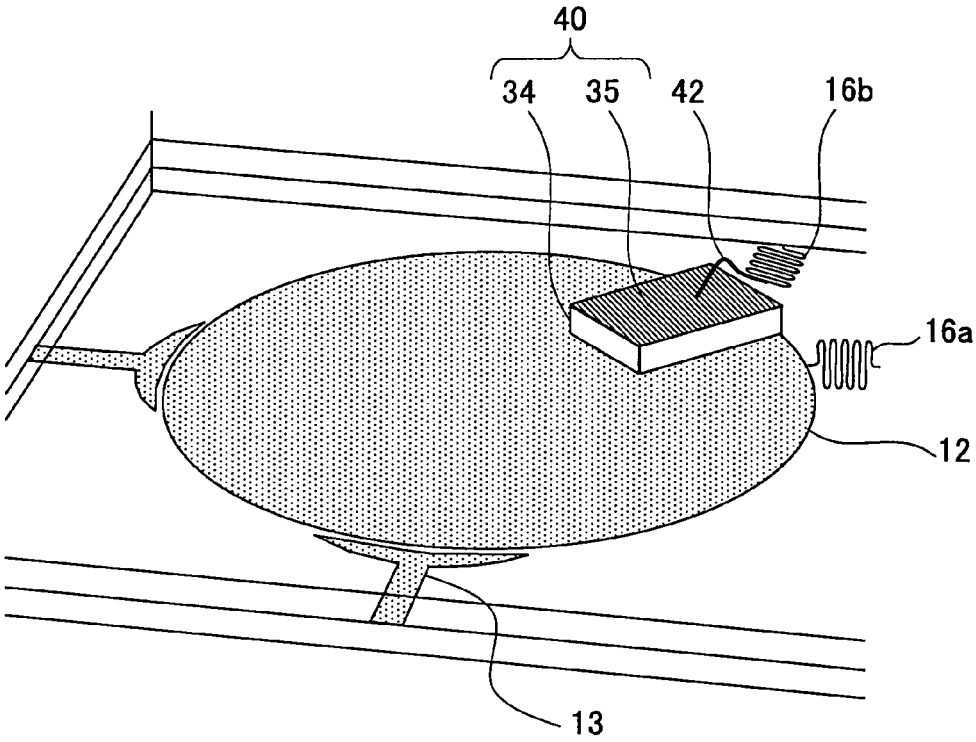
FIG. 9A is a perspective view of the superconducting filter shown in FIG. 8.
Figure 9B:
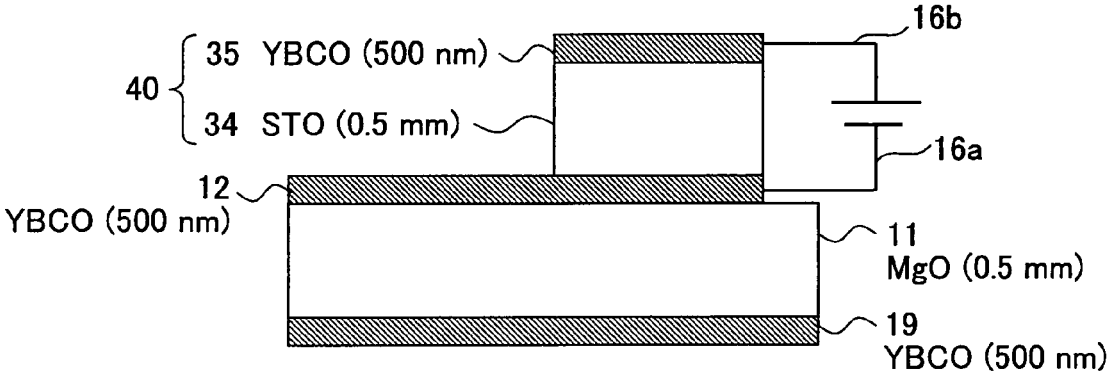
FIG. 9B is a schematic cross-sectional diagram of the superconducting filter.

Next, the second embodiment of the invention is described below. In the previous embodiment, the top dielectric 14 is provided over the entire surface of the superconducting resonator pattern 12, and a bias voltage is applied between the dual-mode producing conducting pattern 15 formed on the top dielectric 14 and the superconducting resonator pattern 12 to efficiently change the center carrier frequency. In the second embodiment as depicted in FIGS. 8, 9A and 9B, a permittivity variable top dielectric 40 is locally placed on a part of the superconducting resonator pattern 12, and a bias voltage is applied between a conductor 35 (FIGS. 9A and 9B) formed over the permittivity variable top dielectric 40 and the superconducting resonator pattern 12. This arrangement is more effective in tuning the passband width of the filter.

FIG. 8 is a top view of a superconducting filter 30 according to the second embodiment of the invention, and FIG. 9A and FIG. 9B are a perspective view and a cross-sectional view, respectively, of the filter 30 in FIG. 8. In the example shown in FIG. 8, a permittivity variable top dielectric 40 with dimensions of 3 mm×2 mm is arranged over a superconducting disk resonator 12 with a diameter ϕ of 11 mm, the superconducting disk resonator 12 being disposed on a base dielectric plate 11. The permittivity variable top dielectric 40 is positioned so as to be point-symmetric with the input/output feeders 13 with respect to the center point of the disk resonator 12. As in the first embodiment, input and output feeders 13 extend to the vicinity of the superconducting resonator pattern 12 at an angle of 90 degrees between them. Accordingly, the permittivity variable top dielectric 40 is positioned in the middle (on the center line C) between the two extended lines of the input and output feeders 13.

In the example shown in FIGS. 8, 9A and 9B, the permittivity variable top dielectric 40 is positioned so as to be aligned with the edge of the superconducting resonator pattern 12; however, it may be moved along the center line C extending between the orthogonally arranged feeders 13 toward the center of the superconducting resonator 12. By placing the permittivity variable top dielectric 40 along the center line C on the resonator pattern 12 (so as to be point-symmetric to the input and output feeders 13 with respect to the center point of the disk resonator 12), the electric current density reducing effect can be maintained satisfactory. It is desired not to place the permittivity variable top dielectric 40 near the input and output feeders 13 nor on the extended lines of these feeders 13.

As illustrated in FIG. 9A and FIG. 9B, the permittivity variable top dielectric 40 includes a dielectric plate 34 made of, for example, SrTiO3 (referred to as "STO"), and a conducting film 35 formed over the top face of the dielectric plate 34. Although in this example the conducting film 35 is made of a superconducting material, it may be formed of gold (Au).

The permittivity variable top dielectric 40 serves as a varactor (variable-capacitance device). By changing the permittivity of the dielectric plate 34 under the application of a bias voltage, the center carrier frequency and/or the passband width of a signal passing through the superconducting filter 30 (which may be used as a bandpass filter, for example) can be controlled.

Bias application wirings 16*a* and 16*b* are formed on the dielectric base plate 11. (FIG. 9B). The bias application wiring 16*a* extends to the disk-shaped superconducting resonator pattern 12, and a bias application wiring 16*b* is connected to the conductor 35 formed on the dielectric plate 34 by wire bonding 42. (FIG. 9A). As in the first embodiment, the bias application wirings 16*a* and 16*b* have hairpin patterns serving as inductance components for blocking the radio frequency component. The patterns of the bias application wirings 16*a* and 16*b* are not limited to the hairpin patterns, but may have square pulse patterns or zigzag patterns consisting of repeated V.

The conducting film 35 of the permittivity variable top dielectric 40 may be formed as a laminate of a superconducting film and a gold (Au) film. In this case, the conducting film 35 serves as a dual-mode producing conductor, and simultaneously, serves as an electrode pad for the wire bonding. The bias application wirings 16*a* and 16*b* are connected to an external DC power source.

As illustrated in FIG. 9B, a ground film 19 is formed of a superconducting material (e.g., YBCO) on the back face of the dielectric base plate (e.g., MgO plate) 11. The superconducting resonator pattern 12 is formed on the top face (opposite to the ground face) of the dielectric base plate 11. The permittivity variable top dielectric 40 is placed on a part of the superconducting resonator pattern 12. By applying a bias voltage between the YBCO film (or the Au film if laminated) 35 of the permittivity variable top dielectric 40 and the superconducting resonator pattern 12 from the DC power source, the dielectric constant of the STO plate 34 can be changed.

In general, as the dielectric constant is greater, the dielectric loss caused under the application of a DC bias increases. Accordingly, instead of placing the permittivity variable top dielectric over the entire surface of the superconducting resonator pattern 12, it is placed only locally on the resonator pattern 12 to reduce the dielectric loss, while maintaining the dual-mode operability and realizing bandwidth tunability.

Figure 10A:
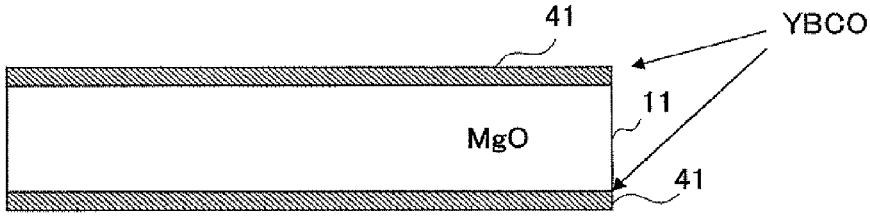
FIG. 10A through FIG. 10E illustrate a fabrication process of the superconducting filter according to the second embodiment of the invention.

FIG. 10A through FIG. 10E illustrate a fabrication process of the superconducting tunable filter 30 according to the second embodiment of the invention. As illustrated in FIG. 10A, a superconducting film (e.g. a YBCO film) 41 with a thickness of 500 nm (see FIG. 9B) is formed over a 0.5 mm (see FIG. 9B) thick dielectric base plate 11 by a PLD method. As in the first embodiment, the dielectric base plate 11 is made of a dielectric material characterized by low transmission loss at radio frequencies, and examples of such a material include MgO, sapphire, and LAO. For the superconducting film 41, RBCO (R—Ba—Cu—O), BSCCO (Bi—Sr—Ca—Cu—O), PBSCCO (Pb—Bi—Sr—Ca—Cu—O), CBCCO (Cu—$Ba_p$—$Ca_q$—$Cu_r$—$O_x$, $1.5<p<2.5$, $2.5<q<3.5$, $3.5<r<4.5$) can be used, in addition to YBCO.

Figure 10B:
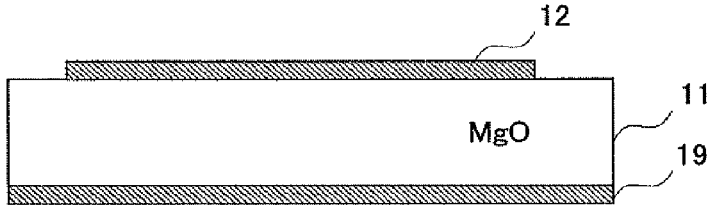

Then, as illustrated in FIG. 10B, the superconducting film on the top face of the dielectric base plate 11 (MgO plate in this case) is patterned into a disk-shaped resonator pattern 12, bias application wiring 16*a* and 16*b* (see FIG. 8), and input/output feeders 13 (see FIGS. 8 and 9A), while maintaining the superconducting film formed on the back face of the dielectric base plate 11. In the patterning process, a resist mask (not shown) is formed over the superconducting film 41 by a conventional lithography technique to perform dry etching, such as argon (Ar) milling. The pattern of the bias application wirings 16*a* and 16*b* has a narrow width and enough length so as to secure sufficient inductance. The superconducting film 41 on the back face is used as the ground film 19.

Figure 10C:
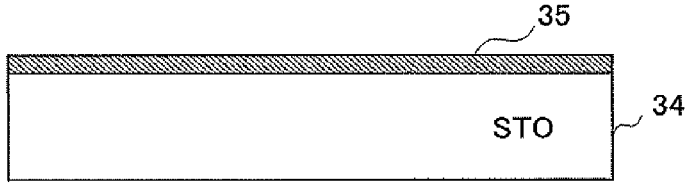
Figure 10D:
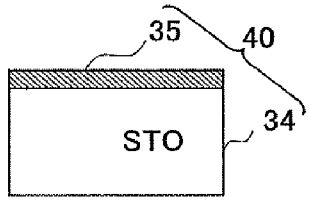

Meanwhile, in FIG. 10C, a YBCO film with a thickness of 500 nm (see FIG. 9B) and a gold (Au) film with a thickness of 500 nm are successively formed over the top face of a 0.5 mm (see FIG. 9B) thick STO (100) substrate 34 by an PLD method to provide a conducting film 35. The STO substrate 34 with the conducting film 35 is cut into a 3 mm×2 mm piece using an ultrasonic processing machine, as illustrated in FIG. 10D. This dice is used as the permittivity variable top dielectric 40. For the dielectric substrate 34, (Ba, Sr)$TiO_3$, $Bi_{1.5}Zn_{1.0}Nb_{1.5}O_7$, $CaTiO_3$ can be used other than STO.

Figure 10E:
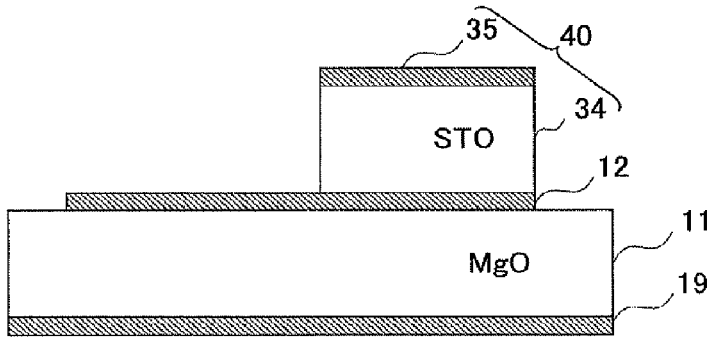

Finally, as illustrated in FIG. 10E, the permittivity variable top dielectric 40 including the STO substrate 34 and the conducting film 35 is placed on the superconducting resonator pattern 12 at a prescribed position such that the uncovered back face (opposite to the face covered with the conducting film 35) is in contact with the resonator pattern 12. The conducting film 35 is electrically connected to the bias application wiring 16*b* (see FIG. 8) formed on the dielectric base plate 11 (MgO plate in this case) by Au wire bonding. The ground film 19 on the dielectric base plate 11 is used as ground.

Figure 11:
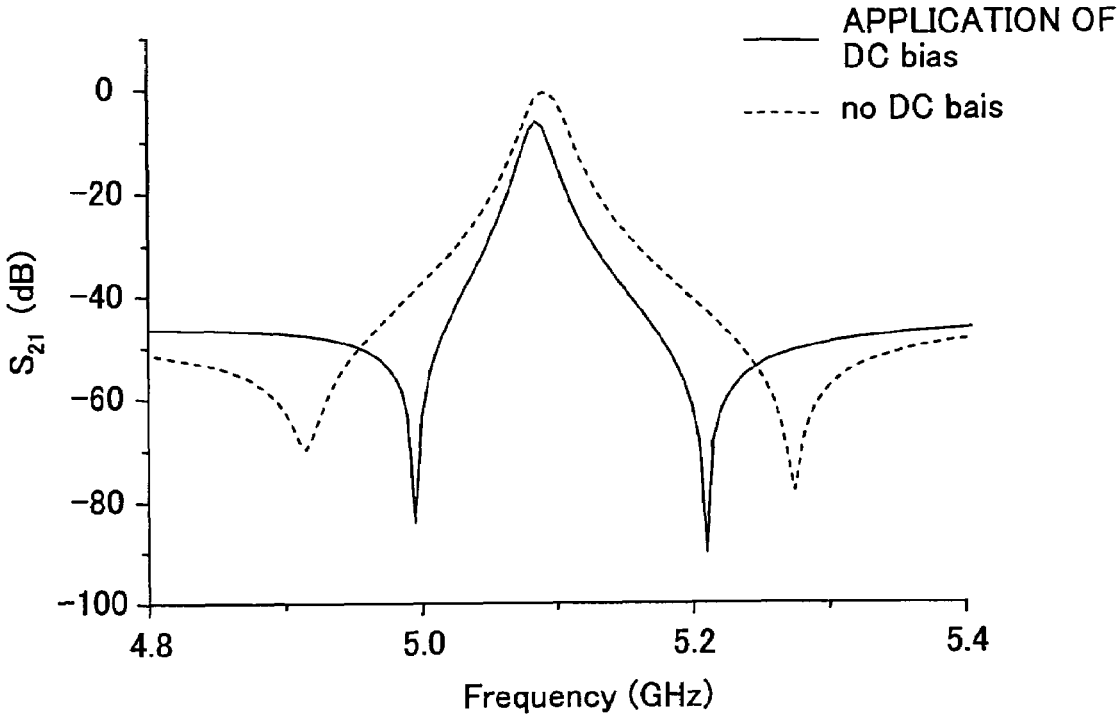
FIG. 11 is a graph showing the bandpass characteristic of the superconducting filter with and without application of a bias voltage according to the second embodiment of the invention.

FIG. 11 is a simulation graph showing the bandpass filter characteristics of the superconducting filter, that is, transmission characteristics ($S_{21}$) as a function of frequency (GHz), according to the second embodiment of the invention. The dashed line indicates the transmission characteristic without application of a DC bias, and the solid line indicates the transmission characteristic under the application of a DC bias. Without the application of a DC current, the dielectric constant of the dielectric plate 34 of the top dielectric 40 is 300 ($\in$=300). Upon application of a DC bias, the dielectric constant changes to 200 ($\in$=200). As a result, the bandwidth can be changed efficiently with little change in the center carrier frequency. In addition, the structure of the second embodiment is advantageous from the viewpoint of the fast response in permittivity change because the permittivity variable top dielectric 40 is locally arranged on the resonator pattern 12 at a prescribed position.

This patent application is based upon and claims the benefit of the earlier filing dates of Japanese Patent Application Nos. 2006-095250 and 2006-346212 filed Mar. 30, 2006 and Dec. 22, 2006, respectively, the entire contents of which are incorporated herein by reference.

What is claimed is:

1. A superconducting tunable filter comprising:

a dielectric base plate;

a patch-shaped resonator pattern includes a superconducting material disposed on the dielectric base plate;

a top dielectric provided over the resonator pattern, the top dielectric includes a material having a non-linear electric-field dependency of permittivity;

a conducting pattern disposed on a top face of the top dielectric to produce coupling corresponding to a prescribed bandwidth; and a bias voltage supply configured to apply a bias voltage to the top dielectric, wherein the bias voltage supply includes a first bias application wiring disposed on the dielectric base plate and connected to the superconducting resonator pattern, and a second bias application wiring disposed on the dielectric base plate and electrically connected to the conducting pattern on the top dielectric.

2. The superconducting tunable filter of claim 1, wherein at least one of the first and second bias application wiring, and includes an inductance component for removing a radio frequency component.

3. The superconducting tunable filter of claim 2, wherein the at least one of the first and second bias application wiring has a hairpin pattern.

4. The superconducting tunable filter of claim 1, wherein the top dielectric comprises one of a perovskite oxide and a pyrochlore oxide.

5. The superconducting tunable filter of claim 1, wherein the top dielectric is a dielectric plate placed on the dielectric base plate with the superconducting resonator pattern disposed on a surface of the dielectric base plate.

6. The superconducting tunable filter of claim 1, wherein the top dielectric is a dielectric film formed by crystal growth over the dielectric base plate with the superconducting resonator pattern disposed on a surface of the dielectric base plate.

7. The superconducting tunable filter of claim 1, wherein the conducting pattern for producing the coupling comprises a superconductor.

8. The superconducting tunable filter of claim 1, wherein the conducting pattern for producing the coupling is round or elliptic in shape.

9. The superconducting tunable filter of claim 1, wherein the first and second bias application wirings have repeating patterns so as to include inductance components.

10. The superconducting tunable filter of claim 1, wherein the second bias application wiring is electrically connected to the conducting pattern on the top dielectric via wire bonding.

11. A superconducting tunable filter comprising:

a dielectric base plate;

a patch-shaped resonator pattern comprised of a superconducting material disposed on the dielectric base plate;

a top dielectric locally placed on the superconducting resonator pattern at a prescribed position, the top dielectric includes a material with an electric-field dependent permittivity;

a conducting pattern disposed on a top face of the top dielectric; and a bias voltage supply configured to apply a bias voltage between the conducting pattern and the superconducting resonator pattern, wherein the bias voltage supply includes a first bias application wiring disposed on the dielectric base plate and connected to the superconducting resonator pattern, and a second bias application wiring disposed on the dielectric base plate and electrically connected to the conducting pattern on the top dielectric.

12. The superconducting tunable filter of claim 11, further comprising:

an input feeder for feeding a signal to the superconducting resonator pattern and an output feeder for outputting the signal from the superconducting resonator pattern;

wherein the top dielectric is placed on a line point-symmetric with the input and output feeders with respect to a center of the superconducting resonator pattern.

13. The superconducting tunable filter of claim 12, wherein the input feeder and the output feeders are arranged so as to make a 90-degree angle therebetween.

14. The superconducting tunable filter of claim 11, wherein the second bias application wiring is electrically connected to the conducting pattern on the top dielectric via wire bonding.

15. The superconducting tunable filter of claim 12, wherein the top dielectric is placed on the superconducting resonator pattern so as not to extend beyond the edge of the superconducting resonator pattern.

16. The superconducting tunable filter of claim 11, wherein the first and second bias application wirings have repeating patterns so as to include inductance components.

* * * * *